US007460088B2

(12) United States Patent
Takeuchi et al.

(10) Patent No.: US 7,460,088 B2
(45) Date of Patent: Dec. 2, 2008

(54) PLASMA DISPLAY APPARATUS

(75) Inventors: Masanori Takeuchi, Kawasaki (JP); Yasuji Noguchi, Kawasaki (JP); Yutaka Chiaki, Kawasaki (JP); Shunji Oota, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 651 days.

(21) Appl. No.: 11/041,412

(22) Filed: Jan. 25, 2005

(65) Prior Publication Data

US 2005/0231444 A1 Oct. 20, 2005

(30) Foreign Application Priority Data

Apr. 16, 2004 (JP) ..... 2004-122044

(51) Int. Cl.
*G09G 3/28* (2006.01)

(52) U.S. Cl. ..... 345/60; 345/63

(58) Field of Classification Search ..... 345/60–63; 315/169.3

See application file for complete search history.

(56) References Cited

U.S. PATENT DOCUMENTS 6,025,818 A * 2/2000 Okano ..... 345/63
6,414,657 B1 7/2002 Kasahara et al.
6,686,698 B2 2/2004 Takeuchi et al.

FOREIGN PATENT DOCUMENTS

| | | |
|---|---|---|
| EP | 1085495 | 3/2001 |
| JP | 6-259034 | 9/1994 |
| JP | 2003-337568 | 11/2003 |
| KR | 2001-30174 | 4/2001 |

OTHER PUBLICATIONS

Korean Office Action, dated Oct. 13, 2006, and issued in related Korean Patent Application No. 10-2005-0013082.

* cited by examiner

*Primary Examiner*—Kevin M Nguyen
(74) *Attorney, Agent, or Firm*—Staas & Halsey LLP

(57) ABSTRACT

A plasma display apparatus, in which the display quality of a dark image is improved and which uses a subfield method, has been disclosed. The plasma display apparatus comprises a plasma display panel, a sustain pulse cycle changing means for detecting the display load ratio of each subfield and changing the sustain pulse cycle of each subfield according to the display load ratio, and an adaptive subfield number changing means for calculating a vacant time in a display frame generated by changing the sustain pulse cycle, judging whether a subfield can be added according to the vacant time, and determining the number of subfields in the display frame.

22 Claims, 12 Drawing Sheets

RESET PERIOD
ADDRESS PERIOD } TOTAL TIME=200 μs
SUSTAIN PERIOD

| | SF1 | SF2 | SF3 | SF4 |
|---|---|---|---|---|
| NUMBER OF SUSTAIN PULSES | 10 | 20 | 40 | 80 |
| SUSTAIN CYCLE | 8 μs | 8 μs | 8 μs | 8 μs |
| SUSTAIN PERIOD | 80 μs | 160 μs | 320 μs | 640 μs |

TOTAL SUSTAIN PERIOD=1200 μs VARIATION TIME=0 μs
TOTAL NUMBER OF SUSTAIN PULSES=150

| | SF1 | SF2 | SF3 | SF4 |
|---|---|---|---|---|
| NUMBER OF SUSTAIN PULSES | 10 | 20 | 40 | 80 |
| SUSTAIN CYCLE | 8 μs | 8 μs | 6 μs | 6 μs |
| SUSTAIN PERIOD | 80 μs | 160 μs | 240 μs | 480 μs |

TOTAL SUSTAIN PERIOD=960 μs VARIATION TIME=240 μs
TOTAL NUMBER OF SUSTAIN PULSES=150

| | SF1 | SF2 | SF3 | SF4 | SF5 |
|---|---|---|---|---|---|
| NUMBER OF SUSTAIN PULSES | 10 | 20 | 40 | 80 | 5 |
| SUSTAIN CYCLE | 8 μs | 8 μs | 6 μs | 6 μs | 8 μs |
| SUSTAIN PERIOD | 80 μs | 160 μs | 240 μs | 480 μs | 40 μs |

TOTAL SUSTAIN PERIOD=1000 μs VARIATION TIME=0 μs
TOTAL NUMBER OF SUSTAIN PULSES

FIG.1

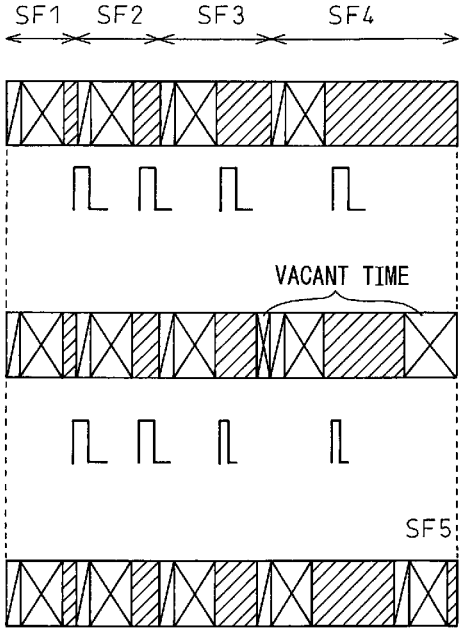

RESET PERIOD
ADDRESS PERIOD } TOTAL TIME=200 μs
SUSTAIN PERIOD

| | SF1 | SF2 | SF3 | SF4 |
|---|---|---|---|---|
| NUMBER OF SUSTAIN PULSES | 10 | 20 | 40 | 80 |
| SUSTAIN CYCLE | 8 μs | 8 μs | 8 μs | 8 μs |
| SUSTAIN PERIOD | 80 μs | 160 μs | 320 μs | 640 μs |

TOTAL SUSTAIN PERIOD=1200 μs VARIATION TIME=0 μs
TOTAL NUMBER OF SUSTAIN PULSES=150

| | SF1 | SF2 | SF3 | SF4 |
|---|---|---|---|---|
| NUMBER OF SUSTAIN PULSES | 10 | 20 | 40 | 80 |
| SUSTAIN CYCLE | 8 μs | 8 μs | 6 μs | 6 μs |
| SUSTAIN PERIOD | 80 μs | 160 μs | 240 μs | 480 μs |

TOTAL SUSTAIN PERIOD=960 μs VARIATION TIME=240 μs
TOTAL NUMBER OF SUSTAIN PULSES=150

| | SF1 | SF2 | SF3 | SF4 | SF5 |
|---|---|---|---|---|---|
| NUMBER OF SUSTAIN PULSES | 10 | 20 | 40 | 80 | 5 |
| SUSTAIN CYCLE | 8 μs | 8 μs | 6 μs | 6 μs | 8 μs |
| SUSTAIN PERIOD | 80 μs | 160 μs | 240 μs | 480 μs | 40 μs |

TOTAL SUSTAIN PERIOD=1000 μs VARIATION TIME=0 μs
TOTAL NUMBER OF SUSTAIN PULSES

FIG. 3A

| | SF1 | SF2 | SF3 | SF4 |
|---|---|---|---|---|
| WEIGHT | 1 | 2 | 4 | 8 |

FIG. 3B

| | SF1 | SF2 | SF3 | SF4 | SF5 |
|---|---|---|---|---|---|
| WEIGHT | 1 | 2 | 4 | 8 | 1/2 |

FIG. 8A

| | SF1 | SF2 | SF3 | SF4 | SF5 | SF6 | SF7 | SF8 | SF9 |
|---|---|---|---|---|---|---|---|---|---|
| WEIGHT | 1 | 2 | 4 | 8 | 16 | 32 | 64 | 128 | 1/2 |

FIG. 8B

| | SF1 | SF2 | SF3 | SF4 | SF5 | SF6 | SF7 | SF8 | SF9 |
|---|---|---|---|---|---|---|---|---|---|
| WEIGHT | 1 | 3 | 7 | 15 | 31 | 63 | 127 | 255 | 2 |

FIG. 8C

| | SF9 | SF1 | SF2 | SF3 | SF4 | SF5 | SF6 | SF7 | SF8 |
|---|---|---|---|---|---|---|---|---|---|
| WEIGHT | 1/2 | 1 | 2 | 4 | 8 | 16 | 32 | 64 | 128 |

FIG. 9A

BEFORE SF IS ADDED

| | SF1 | SF2 | SF3 | SF4 | SF5 | SF6 | SF7 | SF8 | SF9 | SF10 |
|---|---|---|---|---|---|---|---|---|---|---|
| WEIGHT | 1 | 2 | 4 | 8 | 16 | 32 | 32 | 32 | 32 | 32 |

FIG. 9B

AFTER SF IS ADDED

| | SF1 | SF2 | SF3 | SF4 | SF5 | SF6 | SF7 | SF8 | SF9 | SF10 | SF11 |
|---|---|---|---|---|---|---|---|---|---|---|---|
| WEIGHT | 1 | 2 | 4 | 8 | 16 | 32 | 32 | 32 | 32 | 32 | 64 |

FIG. 12A

| | SF1 | SF2 | SF3 | SF4 | SF5 | SF6 | SF7 | SF8 |
|---|---|---|---|---|---|---|---|---|
| WEIGHT | 1 | 2 | 4 | 8 | 16 | 32 | 64 | 128 |

FIG. 12B

| | SF1 | SF2 | SF3 | SF4 | SF5 | SF6 | SF7 | SF8 | SF9 |
|---|---|---|---|---|---|---|---|---|---|
| WEIGHT | 1/2 | 1 | 2 | 4 | 8 | 16 | 32 | 32 | 32 |

FIG. 12C

| | SF1 | SF2 | SF3 | SF4 | SF5 | SF6 | SF7 | SF8 | SF9 |
|---|---|---|---|---|---|---|---|---|---|
| WEIGHT | 1/4 | 1/2 | 1 | 2 | 4 | 8 | 16 | 16 | 16 |

PLASMA DISPLAY APPARATUS

BACKGROUND OF THE INVENTION

The present invention relates to a plasma display apparatus (PDP apparatus) that performs a gradated display using a subfield method and, more particularly, to a technique for improving the display quality of a PDP apparatus.

The plasma display apparatus (PDP apparatus) has been put to practical use as a flat display and is a promising thin display of high-luminance. In the PDP apparatus, as it is possible only to control each display cell to be lit or not, a display frame is made to consist of plural subfields and the subfields to be lit are combined in each cell to perform a gradated display. Each subfield comprises at least an address period during which a display cell is selected and a sustain period during which the selected cell is lit. In the sustain period, a sustain pulse is applied to cause a sustain discharge to occur, and the luminance is determined by the number of sustain pulses. In the following explanation, the total number of sustain pulses in each subfield, that is, the number of sustain pulses that can be applied to each cell in one display frame, is referred to as the total sustain pulse number. If the cycle of the sustain pulse is the same, the luminance is determined by the length of the sustain period. Although the most general and efficient configuration of the subfield is that in which the lengths of the sustain periods in the subfields serially increase and the ratio of the length, that is the luminance, of the sustain period in a subfield to that of the previous one is 2, various subfield configurations have been proposed recently in order to suppress false contours. The present invention can be applied to a PDP apparatus that performs a display using any subfield configuration.

Moreover, various methods have been proposed for the PDP apparatus, and the present invention can be applied to a PDP apparatus that employs any method. As the configurations and the driving methods of the PDP apparatus are widely known, a detailed description is not given here.

One of the problems of a PDP apparatus lies in that the ability to perform the gradated expression is insufficient and particularly, the ability to express low gradations is insufficient. This is because the number of subfields that can be processed in one display frame period is limited.

Techniques for performing the gradated expression without increasing the number of subfields include a method for generating a pseudo-intermediate gradation by the error diffusion process. However, if the error diffusion process is performed, a problem is caused in that dot-like noises become conspicuous particularly in a low-gradated display. This is because the difference in luminance between neighboring gradations is large and the noises are particularly conspicuous in low gradations in which the difference in luminance between neighboring gradations seems to appear relatively large. If the difference in luminance between neighboring gradations is reduced while maintaining the same number of subfields, the peak luminance is lowered, therefore, it is necessary to increase the number of subfields in order to reduce the difference in luminance between neighboring gradations while maintaining the same peak luminance.

Techniques for increasing the number of subfields include a method for increasing the number of subfields, in which a screen is divided vertically into two and driven, thereby the address period is shortened and the shortened periods are combined. However, in order to employ this method, it is necessary to provide an address driver and a sustain drive circuit respectively in the upper and lower screens, therefore, a problem is caused in that the cost and the power consumption are increased.

U.S. Pat. No. 6,414,657 has disclosed the technique for adjusting at least one of the number of gradations, the constant doubling factor, the number of subfields, and the weighting multiple by calculating the amount of false contour noises from the detected movement. To be specific, the configuration in which the number of subfields is increased/decreased according to the average level/peak level of the entire screen has been described, and in this configuration, the number of subfields is increased when the average level of the entire screen is high.

Moreover, U.S. Pat. No. 6,686,698 has described a configuration, in which, after attention is paid to the fact that the display quality is not degraded even when the cycle of a sustain pulse is shortened if the subfield has a low display load ratio, the display load ratio is detected for each subfield, the cycle of a sustain pulse is shortened only in a subfield having a low display load ratio, the total of vacant times generated by shortening in the display frame is redistributed to each subfield, and thus the total number of sustain pulses is increased to increase luminance.

SUMMARY OF THE INVENTION

As described above, according to the configuration of U.S. Pat. No. 6,414,657, the number of subfields is increased when the average level of the entire screen is high. However, a small number of subfields becomes a problem when a dark display having a low average level of the entire screen is performed, and in this case, the configuration described in U.S. Pat. No. 6,414,657 cannot improve the display quality.

Moreover, U.S. Pat. No. 6,686,698 has not described how to increase the number of subfields.

An object of the present invention is to further improve the display quality of a PDP apparatus by solving the above-mentioned problems.

In order to attain the above-mentioned object, in a PDP apparatus according to the present invention, which performs the gradated expression using a subfield method, the display load ratio is detected for each subfield and the cycle of a sustain pulse is shortened when the detected display load ratio is small because the display quality is not degraded in this case, and a vacant time generated in a display frame by shortening the cycle of the sustain pulse is calculated and a subfield is added using the calculated vacant time, if possible. When a subfield is added, a control is carried out so that a display is performed using the increased number of subfields.

The cycle of a sustain pulse is controlled so that a normal display can be performed even when the display load ratio is large. Therefore, a normal operation can be attained even when the cycle of a sustain pulse is shortened, if the subfield has a low display load ratio, and the display quality is not degraded. The reason is described in detail in U.S. Pat. No. 6,686,698.

FIG. 1 is a diagram that illustrates the principles of the present invention. As shown schematically, it is assumed that a display frame is composed of four subfields SF1 to SF4. Each subfield has a reset period, an address period, and a sustain period, and the lengths of the reset period and the address period are the same in all the subfields and the total length of the reset period and the address period is 200 μs. The sustain period is set in accordance with the weight of each subfield. As shown in the top-left figure, before the sustain pulse cycle is changed, the sustain pulse cycle of every subfield is 8 μs, the sustain periods of SF1 to SF4 are, 80 μs, 160

μs, 320 μs, and 640 μs, and the numbers of sustain pulses of SF1 to SF4 are 10, 20, 40, and 80.

When the display load ratios of SF3 and SF4 are below a predetermined value, as shown in the middle-left figure, the sustain pulse cycles of SF3 and SF4 are changed to 6 μs. In this case, if the duty ratio is fixed, the sustain pulse width will change with the same ratio. If the numbers of sustain pulses of SF3 and SF4 are maintained to 40 and 80, vacant times of 80 μs and 160 μs are generated in SF3 and SF4, respectively, and a total vacant time of 240 μs is generated, as a result. Therefore, SF5 is added as shown in the bottom-left figure. The number of sustain pulses in SF5 is 5 and the sustain pulse cycle is 8 μs, therefore, the sustain pulse period is 40 μs. As the total of the reset period and the address period is 200 μs, the period of SF5 is 240 μs. Therefore, as the vacant time described above is equal to the period of SF5, SF5 can be added.

It is preferable that the weight of the subfield to be added be light and, for example, the weight is made lighter than that of the existing subfields. In this case, the weight of the subfield to be added is set so that the number of sustain pulse is the nearest whole number in such a manner that the first weight is the lightest weight of the existing subfields divided by two, the second weight is the first weight divided by two, and so on, and the heavier the weight of a subfield is, the earlier the subfield is added. Moreover, the weight of the subfield to be added may be made heavier than the lightest weight of the existing subfields and lighter than the second lightest weight. In this case, the weight of the subfield to be added is made to equal a weight that corresponds to the difference in weight between the lightest weight of the existing subfields and the second lightest weight divided equally by the number of subfields to be added.

Although the sustain pulse cycle of the subfield to be added may be changed according to the load ratio, it is desirable that the sustain pulse cycle be fixed because the control becomes complex.

Subfields can be arranged arbitrarily in a display frame. For example, subfields may be arranged in a state of being close to the front in a display frame so that a vacant time is generated in the rear of the display frame, or subfields are arranged in a state of being close to the rear in a display frame so that a vacant time is generated in the front of the display frame. When subfields are arranged in a state of being close to the front, a subfield to be added is arranged after all the subfields in the display frame, and when subfields are arranged in a state of being close to the rear, the subfield to be added is arranged before all the subfields in the display frame. However, arrangements are not limited to these, and it is also possible to arrange a subfield to be added in the front in the display frame when subfields are arranged in a state of close to the front, or to arrange a subfield to be added in the rear in the display frame or in the center when subfields are arranged in a state of being close to the rear. Moreover, when subfields are arranged in a display frame, it is also possible to arrange subfields in the order in which the subfield having the heaviest weight is arranged in the rear or front, or in the order in which the subfield having the heaviest weight is arranged in the center. As described above, various arrangements are possible.

Moreover, when the sustain pulse cycle is changed, as the heavier the weight a subfield has, the stronger the influence on the vacant time is, and it may be acceptable that the sustain pulse cycle is changed only for subfields having a luminance weight heavier than a predetermined one.

When the number of subfields is increased, it is also possible to switch a normal subfield configuration to quite a different subfield configuration as well as adding one or more subfields to the normal subfield configuration. In this case, in a similar manner to the above, the display load ratio of each subfield is detected when a display is performed by a predetermined subfield configuration, and the sustain pulse cycle of each subfield is changed according to the detected display load ratio. Then, a vacant time is calculated, which is generated in a display frame by changing the sustain pulse cycle, whether a display by another subfield configuration is possible according to the calculated vacant time, and a subfield configuration in the display frame is determined.

BRIEF DESCRIPTION OF THE DRAWINGS

The features and advantages of the present invention will be more clearly understood from the following description taken in conjunction with the accompanying drawings, in which:

FIG. 1 is a diagram that illustrates the principles of the present invention.

FIG. 3A and FIG. 3B are diagrams that show the subfield configuration in the first embodiment.

FIG. 8A to FIG. 8C are diagrams that show a subfield configuration in another embodiment.

FIG. 9A and FIG. 9B are diagrams that show a subfield configuration in another embodiment.

FIG. 12A to FIG. 12C are diagrams that show the subfield configuration in the third embodiment.

DESCRIPTION OF THE PREFERRED EMBODIMENTS

Figure 2:
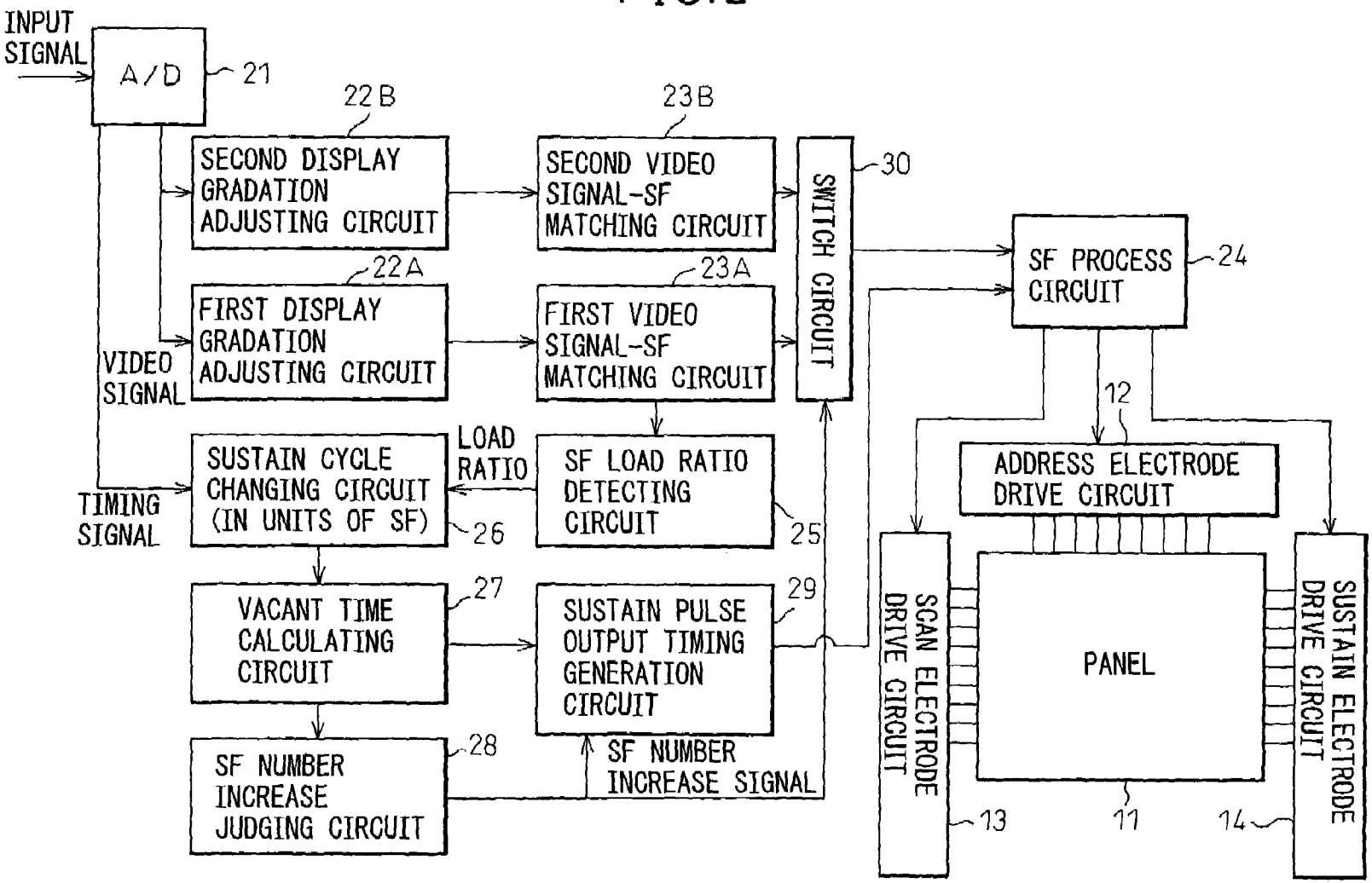
FIG. 2 is a block diagram that shows the general structure of a PDP apparatus in a first embodiment of the present invention.

FIG. 2 is a block diagram that shows the general configuration of the PDP apparatus in the first embodiment of the present invention. As shown schematically, the PDP apparatus comprises a plasma display panel 11, an address electrode drive circuit 12 that puts out a signal to drive the address electrode of the panel 11, a scan electrode drive circuit 13 that puts out a scan pulse to be applied sequentially to a scan electrode (Y electrode) and a reset pulse and a sustain pulse, a sustain electrode drive circuit 14 that puts out a reset pulse and a sustain pulse to be applied to a sustain electrode (X electrode), an A/D conversion circuit 21 that generates a timing signal as well as converting a video input signal into a digital signal, first and second display gradation adjusting circuits 22A and 22B, first and second video signal-SF matching circuits 23A and 23B, a switch circuit 30 that selects an output from the first and second video signal-SF matching circuits 23A and 23B, and an SF process circuit 24 that generates a drive signal for subfield display based on the signal selected by the switch circuit 30, and the drive signal is supplied from the SF process circuit 24 to the address electrode drive circuit 12, the scan electrode drive circuit 13, and the sustain electrode drive circuit 14. The above-mentioned configuration is the same as that of the conventional PDP apparatus according to the prior art except in that two sets of the display gradation adjusting circuits and two sets of the video signal-SF matching circuits are provided and either output is selected in the switch circuit 30 and is supplied to the SF process circuit 24. Therefore, a detailed description of the waveforms, and so on, is not given here.

FIG. 3A and FIG. 3B are diagrams that show the subfield configuration of the PDP apparatus in the first embodiment. Usually, a display is performed by the display frame consisting of four subfields SF1 to SF4 as shown in FIG. 3A, but when a vacant time is increased, a display is performed by the display frame consisting of five subfields SF1 to SF5 as shown in FIG. 3B.

In the subfield configuration shown in FIG. 3A, the four subfields SF1 to SF4, the weight of which increases in such a manner that the ratio of the weight of a subfield to that of the previous one is 2, are arranged in this order. In the subfield configuration shown in FIG. 3B, SF5 having a weight half that of SF1 is added after SF4 in the subfield configuration shown in FIG. 3A. In other words, the added subfield has a weight smaller than that of any other subfield. SF1 to SF4 or SF1 to SF5 are displayed in order from the front one in the display frame and a vacant time is generated in the rear of the display frame. In other words, subfields are displayed in a state of being close to the front in the display frame and a vacant time is generated after all the subfields. However, other arrangement may be possible. For example, subfields may be displayed in a state of being close to the front in the display frame and a vacant time is generated after all the subfields, or a vacant time may be generated in the middle of the display frame.

The first display gradation adjusting circuit 22A adjusts the number of gradations of a video signal by the dithering or error diffusion process and makes an adjustment so that a display is performed by the four subfields SF1 to SF4 shown in FIG. 3A. The second display gradation adjusting circuit 22B also adjusts the number of gradations of a video signal by the dithering or error diffusion process and makes an adjustment so that a display is performed by the five subfields SF1 to SF5 shown in FIG. 3B.

The first video signal-SF matching circuit 23A expands the adjusted video digital signal sent from the first display gradation adjusting circuit 22A and determines a combination of subfields to be lit in order to perform a gradated display in each cell using the four subfields SF1 to SF4. The second video signal-SF matching circuit 23B expands the adjusted video digital signal sent from the second display gradation adjusting circuit 22B and determines a combination of subfields to be lit in order to perform a gradated display in each cell using the five subfields SF1 to SF5.

The PDP apparatus in the first embodiment further comprises an SF load ratio detecting circuit 25 that detects the display load ratio of each subfield, a sustain cycle changing circuit 26 that changes the sustain pulse cycle of each subfield according to the detected display load ratio of each subfield, a vacant time calculating circuit 27 that calculates the vacant time generated by changing the sustain pulse cycle, an SF number increase judging circuit 28 that judges whether SF5 can be added based on the calculated vacant time, and a sustain pulse output timing generation circuit 29 that generates a sustain pulse output timing after the sustain pulse cycle is changed. The sustain pulse output timing generation circuit 29 generates a sustain pulse output timing after the sustain pulse cycles of SF1 to SF4 are changed when SF5 is not added according to the calculated vacant time and the result of the judgment whether SF5 can be added. When SF5 is added, the sustain pulse output timing generation circuit 29 generates a sustain pulse output timing after the sustain pulse cycles of SF1 to SF5 are changed. The switch circuit 30 selects the output of the first video-signal-SF matching circuit 23A when SF 5 is not added according to the result of the judgment whether SF5 can be added, and when SF is added, the switch circuit 30 selects the output of the second video signal-SF matching circuit 23B.

Figure 4:
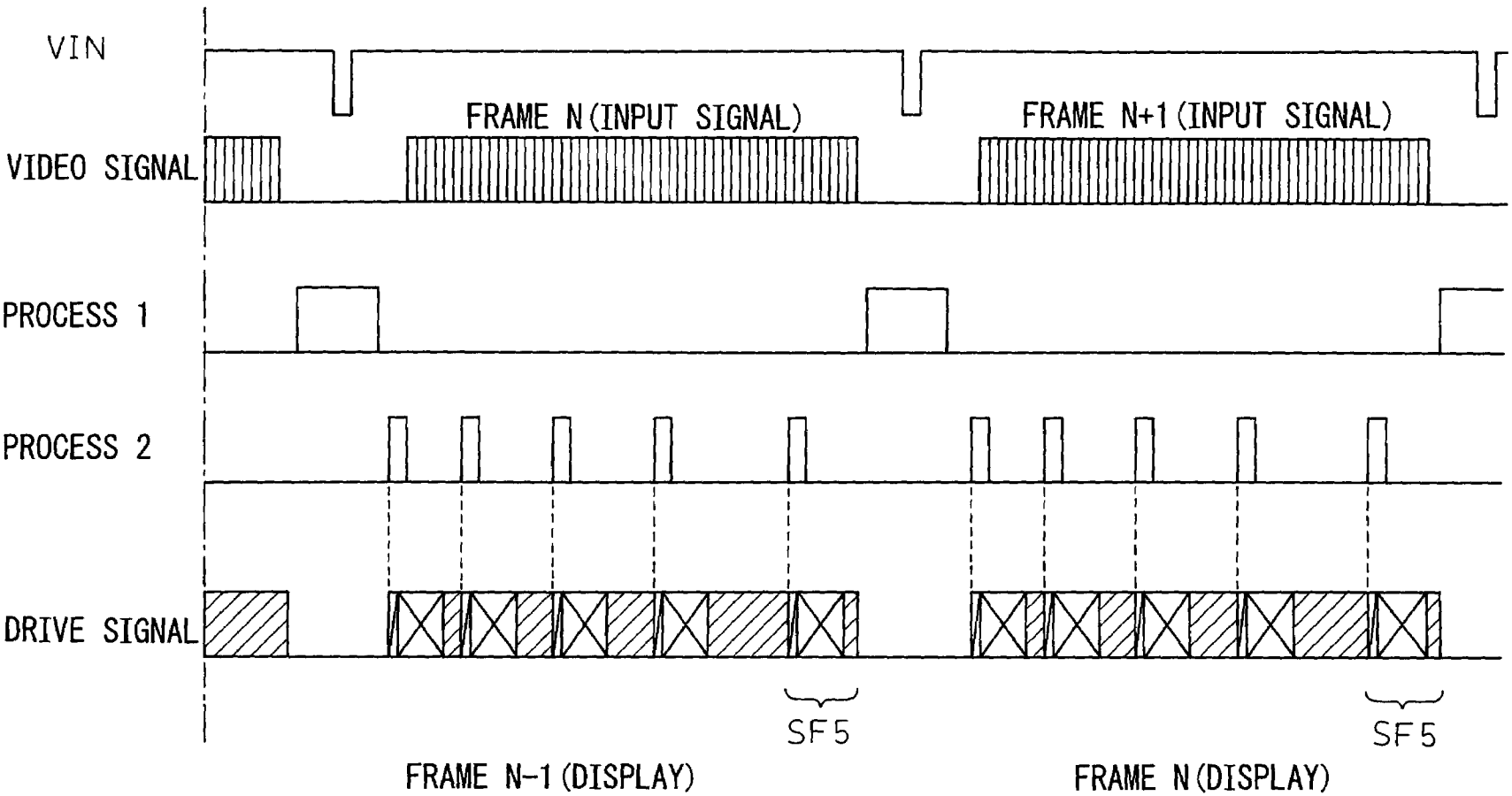
FIG. 4 is a diagram that illustrates the process in the first embodiment.

FIG. 4 is a diagram that illustrates the relationship between the video signal and the processes in the first embodiment. As shown schematically, there is a vertical synchronization signal VIN at the top of a display frame, which detects the start of each display frame. After the vertical synchronization signal VIN, the video signal is input. After all the video signals of each field are input, a process 1 is carried out by the time the input of the video signal of the next field is started. Subsequently, in synchronization with the start of each subfield, a process 2 is carried out and a display is performed by the generation of the drive signal for each subfield.

Figure 5:
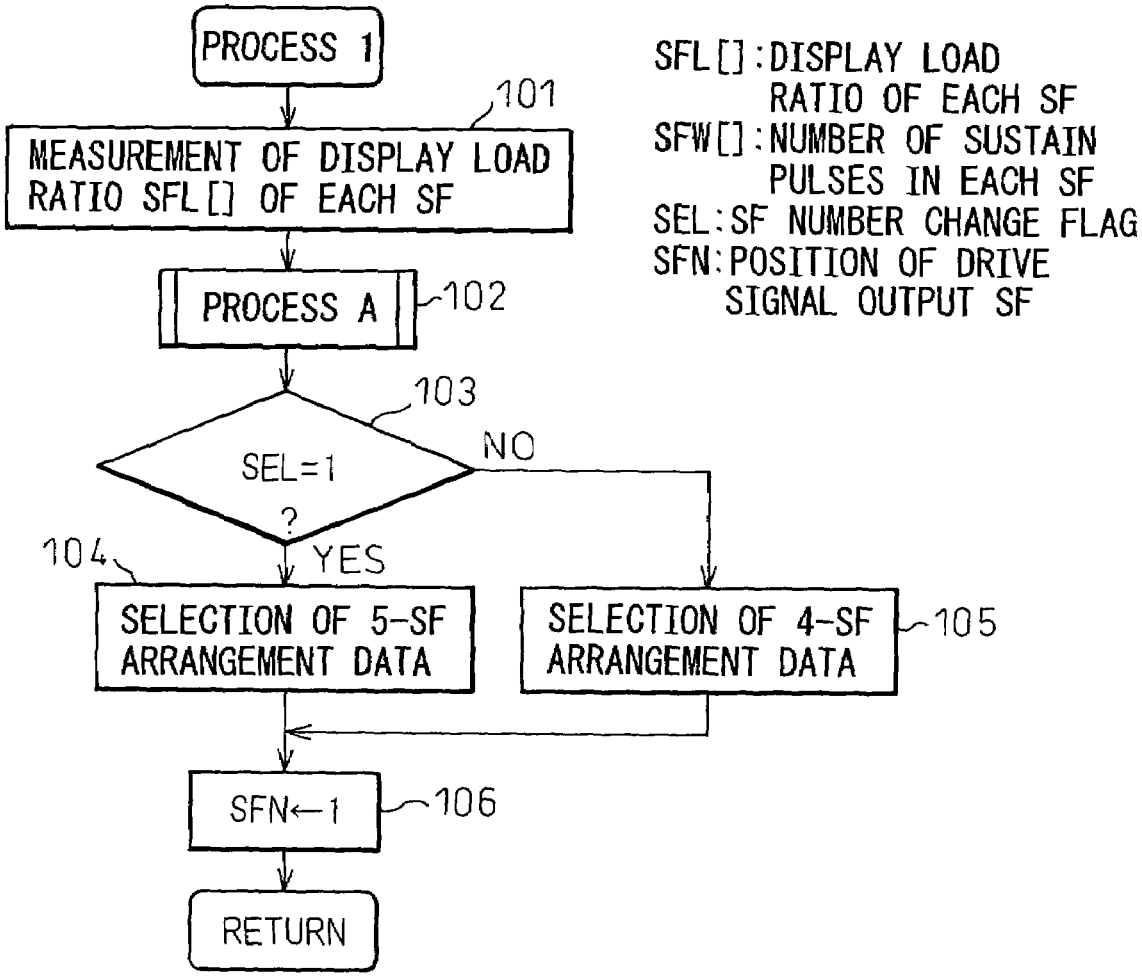
FIG. 5 is a flow chart that shows the process in the first embodiment.
Figure 6:
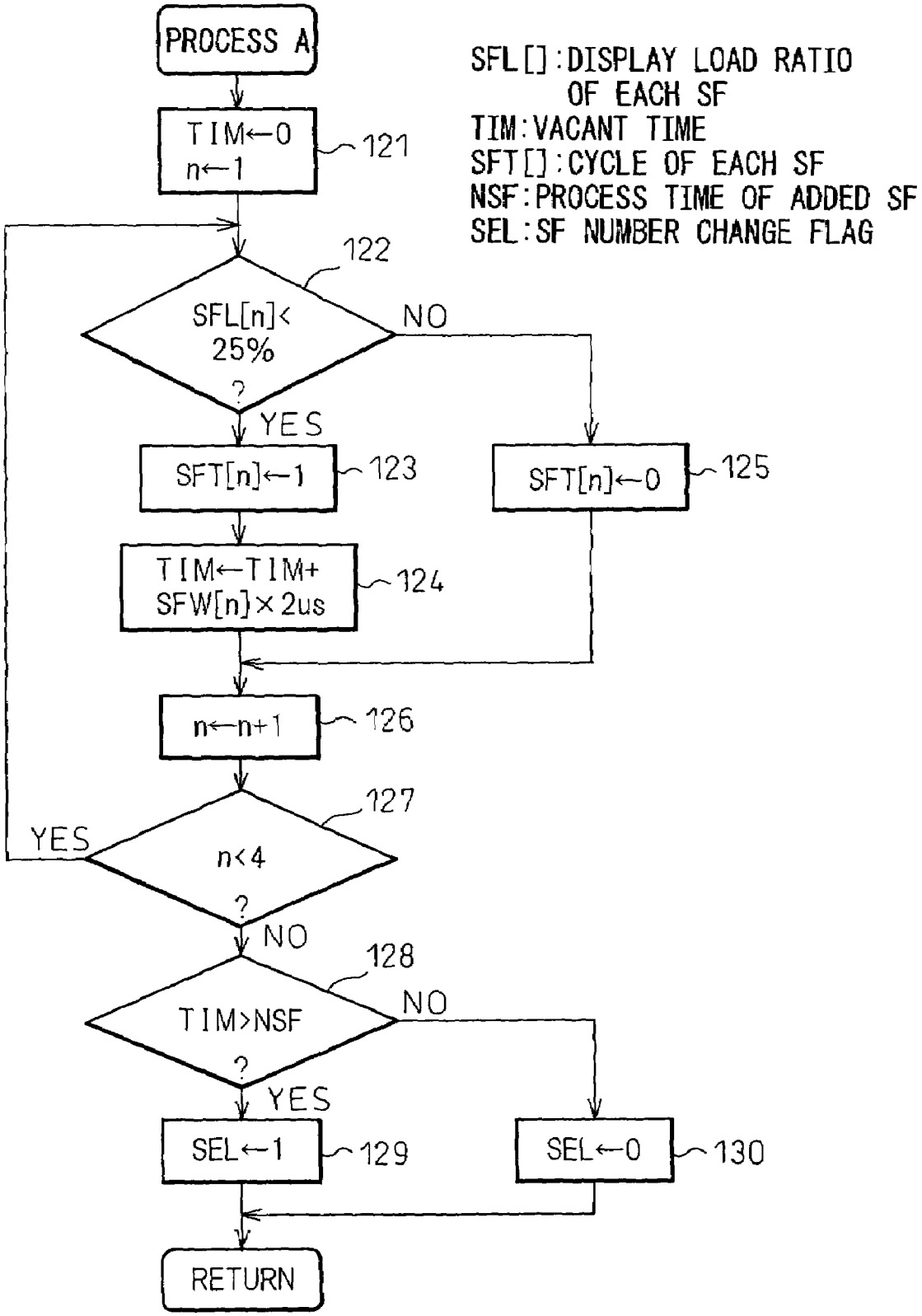
FIG. 6 is a flow chart that shows the process in the first embodiment.

FIG. 5 is a flow chart of the process 1 and FIG. 6 is a flow chart that shows a process A carried out in the process 1.

In step 101, the display load ratio SFL [ ] of each subfield SF is measured. This process is carried out in the SF load ratio detecting circuit 25. In step 102, the process A is carried out. The process A is explained below with reference to FIG. 6.

In step 121, the initial value 0 is allocated to a vacant time TIM and the initial value 1, to a number of subfields n. In step 122, whether the display load ratio SFL [n] of each subfield measured in step 101 is less than 25% is judged, and when less than 25%, the flow advances to step 123 and when equal to or greater than 25%, the flow advances to step 125.

In step 123, in order that the sustain pulse cycle in the subfields in which the display load ratio SFL [n] is less than 25% is changed to 6 μS, 1, which represents 6 μS, is entered into SFT [n]. When the sustain pulse cycle is changed from 8 μS to 6 μS, a vacant time equal to the number of sustain pulses in the subfield SFW [n]×2 μS is generated, therefore, TIM is increased by the corresponding amount in step 124. Then, the flow advances to step 126.

In step 125, on the other hand, 0, which represents 8 μS, is entered into SFT [n] that indicates the sustain pulse cycle. As no vacant time is generated in this case, the flow advances to step 126.

In step 126, the number of subfields n is increased by one, and in step 127, it is judged whether steps 122 to 126 are completed for all the subfields and if not, the flow returns to step 122 and if completed, the flow advances to step 128.

The processes in steps 121 to 127 described above are carried out by the sustain cycle changing circuit 26 and the vacant time calculating circuit 27.

In step 128, it is judged whether the length of the vacant time TIM is equal to or longer than a length that allows SF5 to be added. If SF5 can be added, the flow advances to step 129 and 1 is entered into a flag SEL that indicates that the number of SFs is changed, that is, SF5 is added. When SF5 cannot be added, the flow advances to step 130 and 0 is entered into the flag SEL, indicating that SF5 is not added. After this, the flow returns to step 103 in FIG. 5 and the branch judgment is made based on the flag SEL. The processes in step 102 (process A) and in step 103 are carried out by the SF number increase judging circuit 28.

A control is carried out so that the following processes are performed: when SEL is 1, the flow advances to step 104 and the switch circuit 30 selects display signals by the five subfields SF1 to SF5 put out by the second video signal-SF matching circuit 23B, and when SEL is 0, the flow advances to step 105 and the switch circuit 30 selects display signals by the four subfields SF1 to SF4 put out by the first video signal-SF matching circuit 23A. Therefore, the processes in steps 104 and 105 are carried out by the SF number increase judging circuit 28.

In step 106, 1 is entered into a signal SFN, to be described later, for resetting, which indicates the position of the subfield at which a drive signal is put out.

Figure 7:
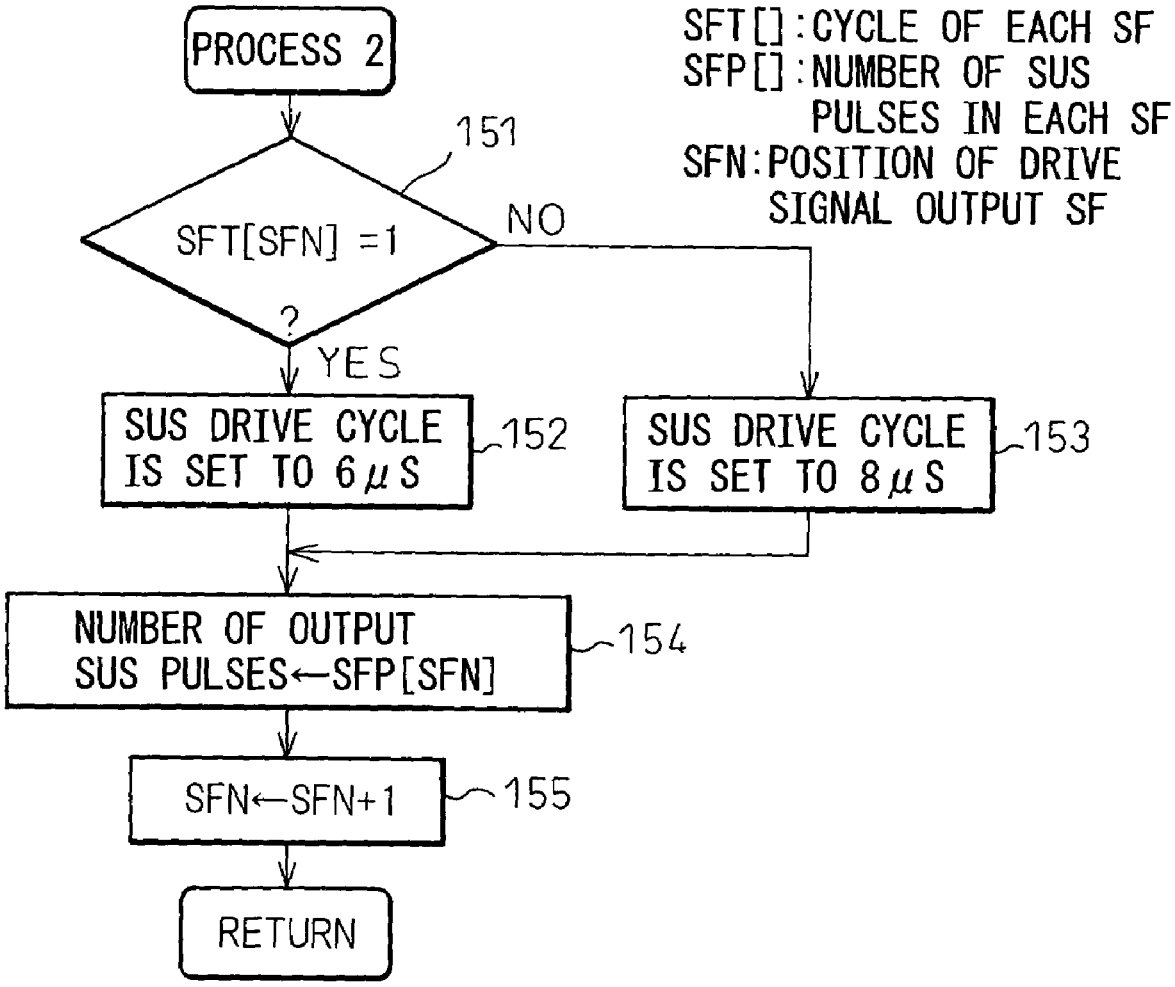
FIG. 7 is a flow chart that shows the process in the first embodiment.

FIG. 7 is a flow chart that shows the process 2.

In step 151, the value of SFT [SFN] that indicates the sustain pulse cycle in the subfield to be processed is judged, and if it is judged to be 1, which corresponds to 6 μS, the flow advances to step 152, and if it is judged to be 0, which corresponds to 8 μS, the flow advances to step 153. In step 152, the sustain pulse cycle is set to 6 μS, and it is set to 8 μS in step 153.

In step 154, the sustain pulse SFP [SFN] of the subfield is read and the number of sustain pulses to be applied is set to the part to be controlled. In step 155, SFN is increased by one for completion.

The process 2 is carried out in synchronization with each subfield, as shown in FIG. 4.

Although only the two levels of 8 μS and 6 μS are provided for the sustain pulse cycle in the first embodiment, it is possible to provide more levels so that, for example, the normal level is 8 μS, is changed to 7 μS when the display load ratio is low, and changed to 6 μS when the display load ratio is even lower.

Moreover, in the first embodiment, for simplicity, a case where the subfield configuration shown in FIG. 3A and FIG. 3B is used is explained, but there can be various modification examples of the subfield configuration and examples are shown in FIG. 8A to FIG. 8*c*, and in FIG. 9A and FIG. 9B.

FIG. 8A to FIG. 8C show examples in which a display frame composed of eight subfields SF1 to SF8 are used normally, but a display frame composed of nine subfields SF1 to SF9 is used when a vacant time longer than a predetermined length is generated. FIG. 8A shows an example in which the eight subfields SF1 to SF8 are arranged in this order, the weight of each of which increases in such a manner that the ratio of the weight of a subfield to that of the previous one is 2, and the weight of SF9, which is to be added, is half that of SF1, and which is added after SF8. FIG. 8B shows an example in which the eight subfields SF1 to SF8 are arranged in this order, the weight of each of which increases in such a manner as shown schematically, and the weight of SF9, which is to be added, is a middle value between SF1 and SF2, and which is added after SF8. FIG. 8C shows an example in which the eight subfields SF1 to SF8 are arranged in this order, the weight of each of which increases in such a manner that the ratio of the weight of a subfield to that of the previous one is 2, and the weight of SF9, which is to be added, is half that of SF1, and which is added before SF1.

In the subfield configuration in FIG. 8B, there exist gradations between the lowest gradation and the highest gradation, which cannot be displayed by SF1 to SF8. For example, gradation 4 can be displayed by a combination of SF1 and SF3 but gradations 2, 5, 6, 9, and 12 to 14 cannot be displayed. Conventionally, such gradations are displayed by the diffusion with respect to time or space using the error diffusion method or dithering method. In the case of the error diffusion method, however, error diffusion noise is produced and, in the case of the dithering method, hatched noise is produced. These noises are particularly likely to be sensed at low gradations. Therefore, in the subfield configuration in FIG. 8B, the weight of the subfield SF9 to be added is set to a value between SF1 and SF2, that is, between the weight of the subfield having the lightest weight and that of the subfield having the second lightest weight. Due to this, in the case where a display is dark all over the screen, which will cause the problem of the above-mentioned noise, a display is performed with SF9 being added and, therefore, the noise can be reduced.

In the normal subfield configurations described above, the subfields are arranged so that each weight thereof increases in order, but the arrangement is not limited to this. For example, the subfields can be arranged so that each weight thereof decreases in order, or so that subfields having a heavy weight are arranged in the vicinity of the center, or conversely, so that subfields having a light weight are arranged in the vicinity of the center.

Moreover, although the object to be changed according to the display load ratio is the sustain pulse cycle of all the subfields, it is also preferable that the object to be changed be the sustain pulse cycle of the subfields, the luminance of which is higher than a predetermined one and which includes one with the maximum luminance, because a longer vacant time is generated when the sustain pulse cycle is shortened in the subfields the luminance ratio of which is high. By restricting the object, the sustain pulse cycle of which is to be changed, the number of operations can be reduced.

In the subfield configuration in the first embodiment and in FIG. 8A and FIG. 8C, the weight of the subfield to be added is lighter than that of the other subfields, and in the subfield configuration in FIG. 8B, the weight of the subfield to be added is between the lightest weight and the second lightest weight. However, it is also possible to add a subfield having a large weight, and an example is shown in FIG. 9A and FIG. 9B.

In the subfield configurations in FIG. 9A and FIG. 9B, the configuration to which no subfield is added is composed of ten subfields SF1 to SF10, in which the weight increases serially from SF1 toward SF6 in such a manner that the ratio of the weight of SF2 to that of SF1 is 2, the ratio of the weight of SF3 to that of SF2 is 2, and so on, but the weight of SF7 to SF10 is the same as that of SF6 having the highest luminance. In other words, there are five subfields having the highest luminance. Due to this, 192 gradations can be displayed including the gradation when the panel is off. Plural subfields having a heavy weight are provided in order to reduce false contours, and the order of arrangement is set adequately. The weight of subfield 11 to be added when a vacant time is generated is twice that of the SF6 to SF10 having the highest luminance.

If the subfield configuration shown in FIG. 9A and FIG. 9B is used, if, for example, it is assumed that the maximum number of sustain pulses in one display frame is 1,000, the number of sustain pulses for one gradation (one ply) in the subfield configuration shown in FIG. 9A is five, and that in the subfield configuration shown in FIG. 9B is four. Therefore, the difference in luminance between neighboring gradations having a low luminance is reduced and the gradated display can be improved.

In the subfield configuration described above, the subfield to be added is one, but it is also possible to add two or more subfields stepwise in accordance with a vacant time. For example, in the subfield configuration shown in FIG. 8A and FIG. 8C, when a vacant time exceeds a predetermined value, SF9 having a weight of ½ is added and when the vacant time further increases, SF10 having a weight of ¼ is added.

Moreover, in the subfield configuration described above, when a subfield is added, the subfield configuration when no subfield is added is maintained. However, it is also possible to make the subfield configuration when a subfield is added differ considerably from that when no subfield is added.

It is also possible to make the total number of sustain pulses of each subfield, after a subfield is added, substantially the same as that before a subfield is added by adjusting the number of sustain pulses, and thereby the variations in the number of sustain pulses due to the addition of a subfield can be prevented.

Figure 10:
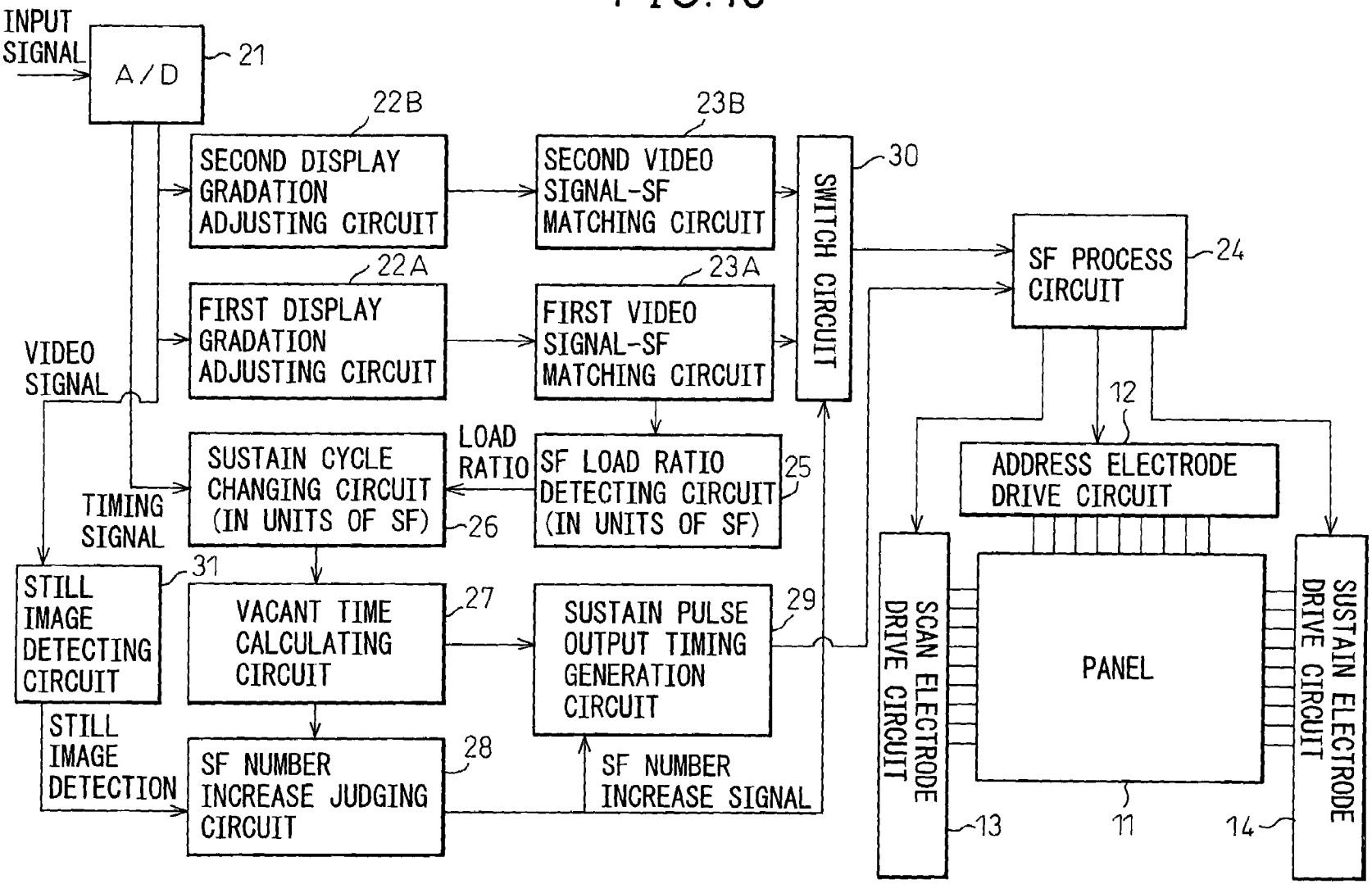
FIG. 10 is a block diagram that shows the general structure of a PDP apparatus in a second embodiment of the present invention.

FIG. 10 is a block diagram that shows the general structure of the PDP apparatus in the second embodiment of the present invention. As is obvious from a comparison with FIG. 2, the PDP apparatus in the second embodiment differs from the PDP apparatus in the first embodiment in that a still image detecting circuit 31 is added. If the vacant time calculated by the vacant time calculating circuit 27 varies between a value that cannot allow a subfield to be added and a value that can allow, the state of the display frame varies frequently between a state in which a subfield cannot be added and a state in which a subfield can be added, that is, the number of subfields varies frequently. This causes a problem in that a display becomes unstable and the display quality is degraded. Such a problem tends to occur when a video substantially the same as a still image is displayed.

Therefore, in the second embodiment, the still image detecting circuit 31 sums differences between respective cells in the current display frame and the previous one, and when the sum is below a predetermined value, the still image detecting circuits 31 judges the display to be a still image and puts out a still image signal. When the SF number increase judging circuit 28 receives the still image signal and a subfield is not added in the previous display frame, a subfield is added when a vacant time W is longer than a time X required for the addition of a subfield plus a buffer time Y, and a subfield is not added when the vacant time W is shorter than the total of the time X and the buffer time Y, and when the SF number increase judging circuit 28 receives the still image and a subfield is added in the previous display frame, a subfield is added when the vacant time W is longer than the time X required for the addition of a subfield and a subfield is not added when the vacant time W is shorter than the time X, in other words, the same control as that in the first embodiment is carried out. When the still image is not received, the same control as that in the first embodiment is carried out. In other words, a hysteresis characteristic is employed in adding and not adding a subfield.

Figure 11:
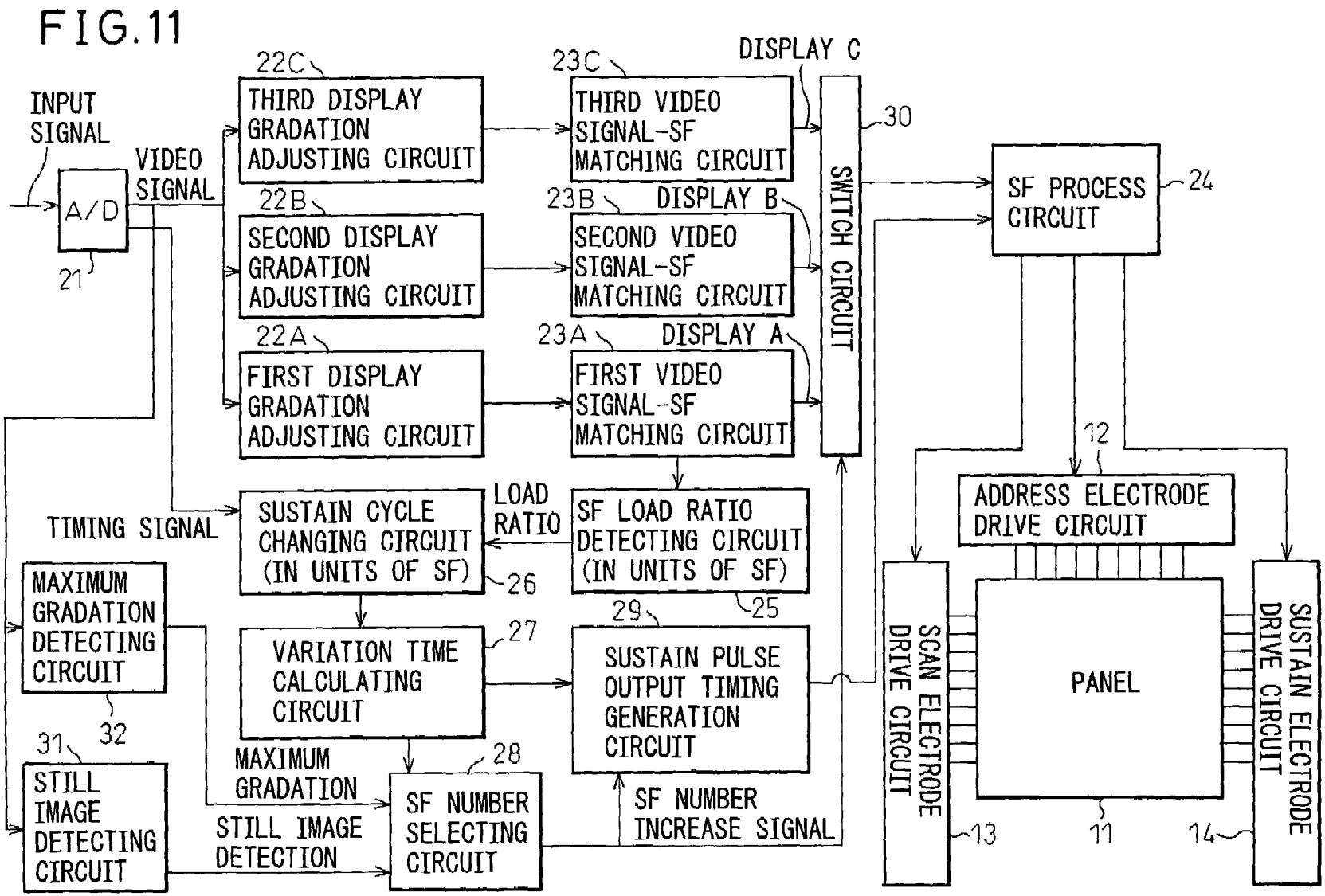
FIG. 11 is a block diagram that shows the general structure of a PDP apparatus in a third embodiment of the present invention.

FIG. 11 is a block diagram that shows the general structure of the PDP apparatus in the third embodiment of the present invention. As is obvious from a comparison with FIG. 10, the PDP apparatus in the third embodiment differs from the PDP apparatus in the second embodiment in that a third display gradation adjusting circuit 22C, a third video signal-SF matching circuit 23C, and a maximum gradation detecting circuit 32 are added.

In the third embodiment, the first display gradation adjusting circuit 22A and the first video signal-SF matching circuit 23A carry out a process based on the subfield configuration shown in FIG. 12A and puts out a display signal A, the second display gradation adjusting circuit 22B and the second video signal-SF matching circuit 23B carry out a process based on the subfield configuration shown in FIG. 12B and puts out a display signal B, and the third display gradation adjusting circuit 22C and the third video signal-SF matching circuit 23C carry out a process based on the subfield configuration shown in FIG. 12C and puts out a display signal C.

The maximum gradation detecting circuit 32 detects the maximum gradation in an input video signal and sends the maximum gradation to the SF number selecting circuit 28. The SF number increase judging circuit 28 controls the switch circuit 30 to select any one of the above-mentioned display signals A, B, and C based on the calculated vacant time and the maximum gradation. For example, the display signal A can display up to 255 gradations, the display signal B, up to 127.5 gradations, and the display signal C, up to 63.75 gradations.

Therefore, when the maximum gradation of an input signal is 63 or lower and the vacant time is longer than or equal to a time that can allow a display by the subfield configuration in FIG. 12C, the display signal C is selected, when the maximum gradation of an input signal is 127 or lower and the vacant time is longer than or equal to a time that can allow a display by the subfield configuration in FIG. 12B, the display signal B is selected, and the display signal A is selected in other cases. Due to this, the ability to express low gradations is improved and, at the same time, the false contours can be reduced.

Although the embodiments of the present invention are described as above, there can be various modification examples and in particular, the present invention can be applied to any subfield configuration.

According to the present invention, the ability to express gradation in a plasma display apparatus, in particular, the ability to express small gradations when a totally dark display is performed, can be improved and a plasma display apparatus with a high display quality can be realized.

The display quality can be improved by increasing the number of subfields for a totally dark image, and according to the present invention, the display quality of a PDP apparatus can be improved by increasing the number of subfields in such a case.

We claim:

1. A plasma display apparatus, which performs a gradated display using a subfield method, comprising:

a plasma display panel having a plurality of scan electrodes and a plurality of sustain electrodes extending in the same direction and being arranged adjacent to each other, and a plurality of address electrodes extending in a direction intersecting at that of the plurality of scan electrodes and the plurality of sustain electrodes;

sustain pulse cycle changing circuitry detecting a display load ratio of each subfield of a plurality of subfields, and shortening a sustain pulse cycle of each respective subfield of the plurality of subfields in which the detected display load ratio of the respective subfield is less than a predetermined value; and adaptive subfield number changing circuitry calculating a vacant time in a display frame generated by said shortening, judging whether a subfield is to be added according to the calculated vacant time, and determining the number of subfields in the display frame according to said judging.

2. The plasma display apparatus as set forth in claim 1, wherein the weight of a subfield to be added is less than that of the existing subfields.

3. The plasma display apparatus as set forth in claim 2, wherein the weight of a subfield to be added is set so that the number of sustain pulses is the nearest whole number in such a manner that the weight of a first added subfield with the first weight is the least of the weights of the existing subfields divided by two, the weight of a second added subfield with the second weight is the first weight divided by two, and so on, and the adaptive subfield number changing circuitry adds a subfield in order of the first added subfield and the second added subfield.

4. The plasma display apparatus as set forth in claim 1, wherein the weight of a subfield to be added is larger than the least weight of the existing subfields and less than the second least weight.

5. The plasma display apparatus as set forth in claim 4, wherein the weight of a subfield to be added is a weight depending on an intermediate value between the least weight of the existing subfields and the second least weight.

6. The plasma display apparatus as set forth in claim 1, wherein the sustain pulse cycle of a subfield to be added is fixed.

7. The plasma display apparatus as set forth in claim 1, wherein subfields are arranged in a state of being close to a front in a display frame so that a vacant time is generated in a rear of the display frame, and a subfield to be added is arranged after all the subfields in the display frame.

8. The plasma display apparatus as set forth in claim 1, wherein subfields are arranged in a state of being close to a rear in a display frame so that a vacant time is generated in a front of the display frame, and a subfield to be added is arranged before all the subfields in the display frame.

9. The plasma display apparatus as set forth in claim 1, wherein the sustain pulse cycle changing circuitry shortens the sustain pulse cycle only for subfields having a luminance weight larger than a predetermined luminance weight when the detected display load ratio is less than a predetermined value.

10. A plasma display apparatus, which performs the gradated display using a subfield method, comprising:

a plasma display panel having a plurality of scan electrodes and a plurality of sustain electrodes extending in the same direction and being arranged adjacent to each other, and a plurality of address electrodes extending in a direction perpendicular to that of the plurality of scan electrodes and the plurality of sustain electrodes;

sustain pulse cycle changing circuitry detecting a display load ratio of each subfield of a plurality of subfields when a display is performed by a predetermined subfield configuration, and shortening the sustain pulse cycle of each respective subfield of the plurality of subfields in which the detected display load ratio of the respective subfield is less than a predetermined value; and adaptive subfield configuration setting circuitry calculating a vacant time in a display frame generated by said shortening, judging whether a display is to be performed by another subfield configuration according to the calculated vacant time, and determining a subfield configuration in the display frame according to said judging.

11. A driving method of a plasma display apparatus by performing a gradated display using a subfield method, comprising:

detecting a display load ratio for each subfield of a plurality of subfields;

shortening a sustain pulse cycle of each respective subfield of the plurality of subfields in which the detected display load ratio of the respective subfield is less than a predetermined value;

calculating a vacant time in a display frame generated by said shortening sustain pulse cycle;

judging whether a subfield is to be added according to the calculated vacant time; and determining the number of subfields in the display frame according to said judging.

12. The driving method as set forth in claim 11, wherein the weight of a subfield to be added is less than that of the existing subfields.

13. The driving method as set forth in claim 12, wherein the weight of a subfield to be added is set so that the number of sustain pulses is the nearest whole number in such a manner that the first weight is the least of the weights of the existing subfields divided by two, the second weight is the first weight divided by two, and so on, and a subfield having a larger weight is given priority to be added.

14. The driving method as set forth in claim 11, wherein the weight of a subfield to be added is larger than the least weight of the existing subfields and less than the second least weight.

15. The driving method as set forth in claim 14, wherein the weight of a subfield to be added is a weight depending on an intermediate value between the least weight of the existing subfields and the second least weight.

16. The driving method as set forth in claim 11, wherein the sustain pulse cycle of a subfield to be added is fixed.

17. The driving method as set forth in claim 11, wherein subfields are arranged in a state of being close to a front in a display frame so that a vacant time is generated in a rear of the display frame, and a subfield to be added is arranged after all the subfields in the display frame.

18. The driving method as set forth in claim 11, wherein subfields are arranged in a state of being close to a rear in a display frame so that a vacant time is generated in a front of the display frame, and a subfield to be added is arranged before all the subfields in the display frame.

19. The driving method as set forth in claim 11, wherein the shortening of the sustain pulse cycle of a respective subfield is carried out, when the detected display load ratio of the respective subfield is less than a predetermined value, only for subfields having a luminance weight larger than a predetermined weight.

20. A driving method of a plasma display apparatus by performing a gradated display using a subfield method, comprising:

detecting the display load ratio of each subfield of a plurality of subfields;

shortening, when a display is performed by a predetermined subfield configuration. a sustain pulse cycle of each respective subfield of the plurality of subfields in which the detected display load ratio of the respective subfield is less than a predetermined value;

calculating a vacant time in a display frame generated by said shortening;

judging whether a display is to be performed by another subfield configuration according to the calculated vacant time; and determining a subfield configuration in the display frame according to said judging.

21. A method comprising:

detecting a display load ratio of each subfield of a plurality of subfields of a display frame of a plasma display panel, each subfield of the plurality of subfields having a sustain pulse applied to the respective subfield;

shortening a sustain pulse cycle of the sustain pulse applied to each subfield of the plurality of subfields in which the detected display load ratio is less than a predetermined value calculating a vacant time in the display frame generated by said shortening;

judging whether a subfield is to be added to the display frame according to the calculated vacant time; and determining a subfield configuration of the display frame according to said judging.

22. An apparatus comprising:

means for detecting a display load ratio of each subfield of a plurality of subfields of a display frame of a plasma display panel, each subfield of the plurality of subfields having a sustain pulse applied to the respective subfield;

means for shortening a sustain pulse cycle of the sustain pulse applied to each subfield of the plurality of subfields in which the detected display load ratio is less than a predetermined value;

means for calculating a vacant time in the display frame generated by the shortening of the sustain pulse cycle of the sustain pulse applied to each subfield of the plurality of subfields in which the detected display load ratio is less than a predetermined value;

means for judging whether a subfield is to be added to the display frame according to the calculated vacant time; and means for determining a subfield configuration of the display frame according to the judging whether a subfield is to be added to the display frame according to the calculated vacant time.

* * * * *

UNITED STATES PATENT AND TRADEMARK OFFICE

CERTIFICATE OF CORRECTION

PATENT NO. : 7,460,088 B2
APPLICATION NO. : 11/041412
DATED : December 2, 2008
INVENTOR(S) : Masanori Takeuchi et al.

It is certified that error appears in the above-identified patent and that said Letters Patent is hereby corrected as shown below:

Column 11, Line 62, change “shortening sustain pulse cycle;” to --shortening;--.

Column 12, Line 42, change “configuration.” to --configuration,--.

Column 12, Line 61-62, change “value calculating a vacant time in the display frame generated by said shortening;” to --value; calculating a vacant time in the display frame generated by said shortening;--.

Signed and Sealed this

Twenty-fourth Day of February, 2009

JOHN DOLL
*Acting Director of the United States Patent and Trademark Office*